US005803373A

United States Patent [19]

Sedlock, Jr. et al.

[11] Patent Number: 5,803,373

[45] Date of Patent: Sep. 8, 1998

[54] WATER-RESISTANT ROLL TOWEL DISPENSER

[75] Inventors: Ernest P. Sedlock, Jr., Marietta, Ga.; Robert M. Coggeshall, Meredith, N.H.

[73] Assignee: Kimberly-Clark Worldwide, Inc., Neenah, Wis.

[21] Appl. No.: 814,170

[22] Filed: Mar. 10, 1997

[51] Int. Cl.[6] ..... B65H 16/00

[52] U.S. Cl. ..... 242/596.8; 312/34.8

[58] Field of Search ..... 242/596.8, 597.8, 242/598.5; 312/34.1, 34.8

[56] References Cited

U.S. PATENT DOCUMENTS

| | | | |
|---|---|---|---|
| 843,579 | 2/1907 | Burr et al. . | |
| 883,538 | 3/1908 | Graser . | |
| 2,137,488 | 11/1938 | Harvey . | |
| 3,140,060 | 7/1964 | Layton et al. | 242/596.8 |
| 3,401,993 | 9/1968 | Fenkel . | |
| 3,703,323 | 11/1972 | Gallas et al. . | |
| 3,865,295 | 2/1975 | Okamura . | |
| 3,865,323 | 2/1975 | Stronge et al. . | |
| 5,170,958 | 12/1992 | Brown | 312/34.8 |
| 5,186,376 | 2/1993 | Scharf et al. . | |
| 5,294,192 | 3/1994 | Omdoll et al. . | |

*Primary Examiner*—John P. Darling
*Attorney, Agent, or Firm*—Dority & Manning, P.A.

[57] ABSTRACT

A roll towel dispenser is constructed to inhibit ingress of water into the dispenser cabinet during washdown operations. The dispenser includes a back housing portion for mounting to a planar mounting surface, such as a wall. A front housing portion is closeable on the back housing portion to define an interior compartment and a dispensing slot. The front housing portion and back housing portion define a lip and groove arrangement forming a labyrinthine seal when the dispenser housing is closed. A deflector shield is defined at a lower region of the back housing portion to inhibit entry of sprayed liquid through the dispensing slot. In addition, the latch mechanism utilized to releasably maintain the front housing portion closed on the back housing portion is constructed to inhibit ingress of liquid. A support structure located in the compartment rotatably supports the roll of towel product for dispensing through the slot.

39 Claims, 7 Drawing Sheets

WATER-RESISTANT ROLL TOWEL DISPENSER

BACKGROUND OF THE INVENTION

The present invention relates generally to a dispenser for roll web product, such as roll towel product. More particularly, the invention relates to a roll towel dispenser which is resistant to water penetration during routine cleaning procedures.

Roll towel dispensers are often provided in public or commercial facilities subject to cleaning by "washdown." In other words, the facility is cleaned by a high-pressure spray of detergent and water instead of more labor intensive (and often less thorough) hand washing techniques. Many such facilities, such as industrial food preparation facilities and public washrooms, may be subject to washdown one or more times per day.

During the washdown procedure, liquid may penetrate the cabinet of the roll towel dispenser. As a result, the towel product located inside can be ruined, necessitating wasteful replacement of the roll. To prevent this occurrence, many workers have resorted to removing the dispenser before each washdown and remounting it to the wall thereafter.

SUMMARY OF THE INVENTION

The present invention recognizes and addresses the foregoing disadvantages, and others, of prior art constructions and methods.

Accordingly, it is an object of the present invention to provide an improved dispenser for roll web product.

It is a more particular object of the present invention to provide an improved dispenser for roll web product which is water-resistant.

It is a further object of the present invention to provide an improved dispenser for roll web product having one or more water-resistant features.

It is a more specific object of the present invention to provide an improved dispenser for roll web product having a combination of water-resistant features.

Some of these objects are achieved by a water-resistant roll web dispenser comprising a back housing portion adapted to facilitate mounting of the dispenser to a mounting surface. The dispenser further comprises a front housing portion pivotally connected to the back housing portion. The front housing portion is closeable on the back housing portion to define a compartment and a dispenser slot through which web product extends. A support structure is located in the compartment to rotatably support a roll of the web product.

One of the front housing portion and the back housing portion defines a perimeter groove. Another of the front housing portion and the back housing portion defines a perimeter lip for receipt in the groove. The lip and groove together form a labyrinthine seal structure when the front housing portion is closed on the back housing portion.

In some presently preferred embodiments, the groove is defined on the front housing portion and the lip is defined on the back housing portion. In this case, the groove may advantageously define a water-deflecting bulge on a outer surface of the front housing portion. In addition, the opposed inside walls of the groove are preferably tapered to define a widened mouth. The lip may define a tapered portion having a reduced edge width.

Other objects of the present invention are achieved by a water-resistant roll web dispenser comprising a back housing portion adapted to facilitate mounting of the dispenser to a mounting surface. The dispenser further comprises a front housing portion pivotally connected to the back housing portion. The front housing portion is closeable on the back housing portion to define a compartment and a dispenser slot through which web product extends. A support structure is located in the compartment to rotatably support a roll of the web product.

The back housing portion integrally defines a generally planar back plate and a lower deflector shield. An edge of the deflector shield may define one side of the dispenser slot and is configured to inhibit ingress of water reflected from the mounting surface into the compartment.

In presently preferred embodiments, the deflector shield comprises a first planar portion extending from the back plate at a first predetermined angle and a second planar portion extending from the first planar portion at a second predetermined angle. For example, the second planar portion may be situated approximately perpendicular to the back plate. In addition, a roller may be situated in opposition to the edge of the deflector shield to define a second side of the dispenser slot.

Other objects of the invention are achieved by a water-resistant roll web dispenser comprising a back housing portion adapted to facilitate mounting of the dispenser to a mounting surface. The dispenser further comprises a front housing portion pivotally connected to the back housing portion. The front housing portion is closeable on the back housing portion to define a compartment and a dispenser slot through which web product extends. A support structure is located in the compartment to rotatably support a roll of the web product.

A latch mechanism is provided to maintain the front housing portion closed on the back housing portion. The latch mechanism includes a water-resistant release button extending through the front housing portion. In presently preferred embodiments, the water-resistant release button includes a button member encased in a water-resistant grommet. The water-resistant grommet is preferably attached to the front housing portion.

Still further objects of the invention are achieved by a water-resistant paper product dispenser comprising a back housing portion and a front housing portion closeable on the back housing portion to define a compartment and a dispenser slot through which paper product extends. A support structure is located in the compartment to maintain the paper product.

One of the front housing portion and the back housing portion defines a perimeter groove and another of the front housing portion and the back housing portion defines a perimeter lip for receipt in the groove. The lip and groove form a labyrinthine seal structure when the front housing portion is closed on the back housing portion.

In addition, the back housing portion integrally defines a generally planar back plate and a lower deflector shield. The lower deflector shield extends in an inward direction toward the dispenser slot.

The dispenser further comprises a latch mechanism to maintain the front housing portion closed on the back housing portion. The latch mechanism includes a water-resistant release button extending through the front housing portion.

Other objects, features and aspects of the present invention are provided by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
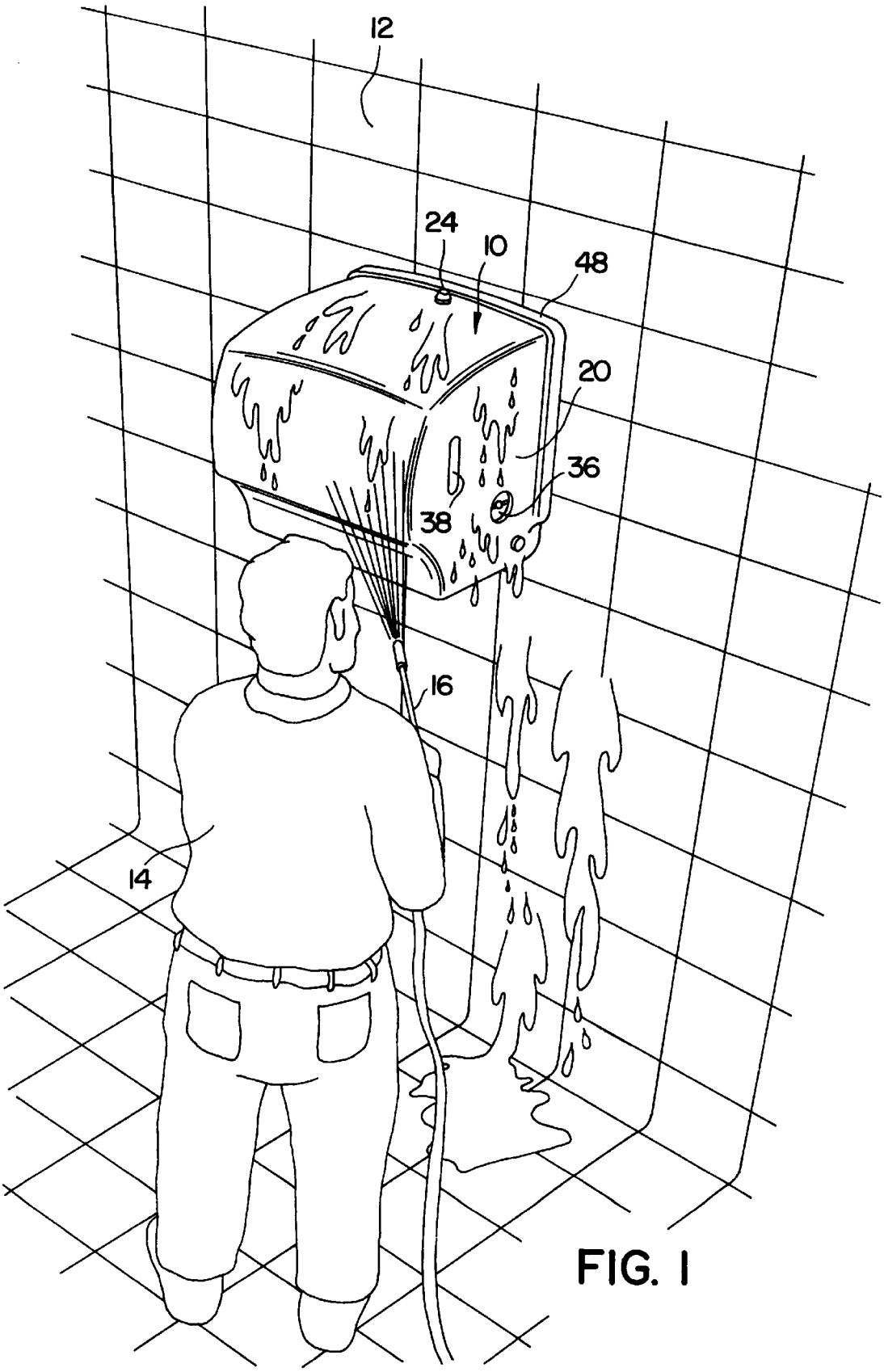
FIG. 1 is a perspective view of a roll web dispenser of the present invention mounted to a wall during a washdown procedure.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

Many prior art dispensers for roll towel product have not proven to be adequately water-resistant. Water penetration can be especially problematic when the dispenser is installed in a facility that may be cleaned by washdown as described above. The present invention provides an improved dispenser for roll towel product that is relatively immune to liquid penetration during routine washdown procedures.

FIG. 1 illustrates a water-resistant roll towel dispenser 10 constructed in accordance with the present invention. In particular, dispenser 10 is mounted the wall 12 of a facility subject to frequent washdown. As shown, the washdown procedure is performed in this case by a worker 14 using a high-pressure wand 16. Despite water impinging upon its cabinet, dispenser 10 contains a number of features that facilitate resistance to liquid penetration.

Figure 2:
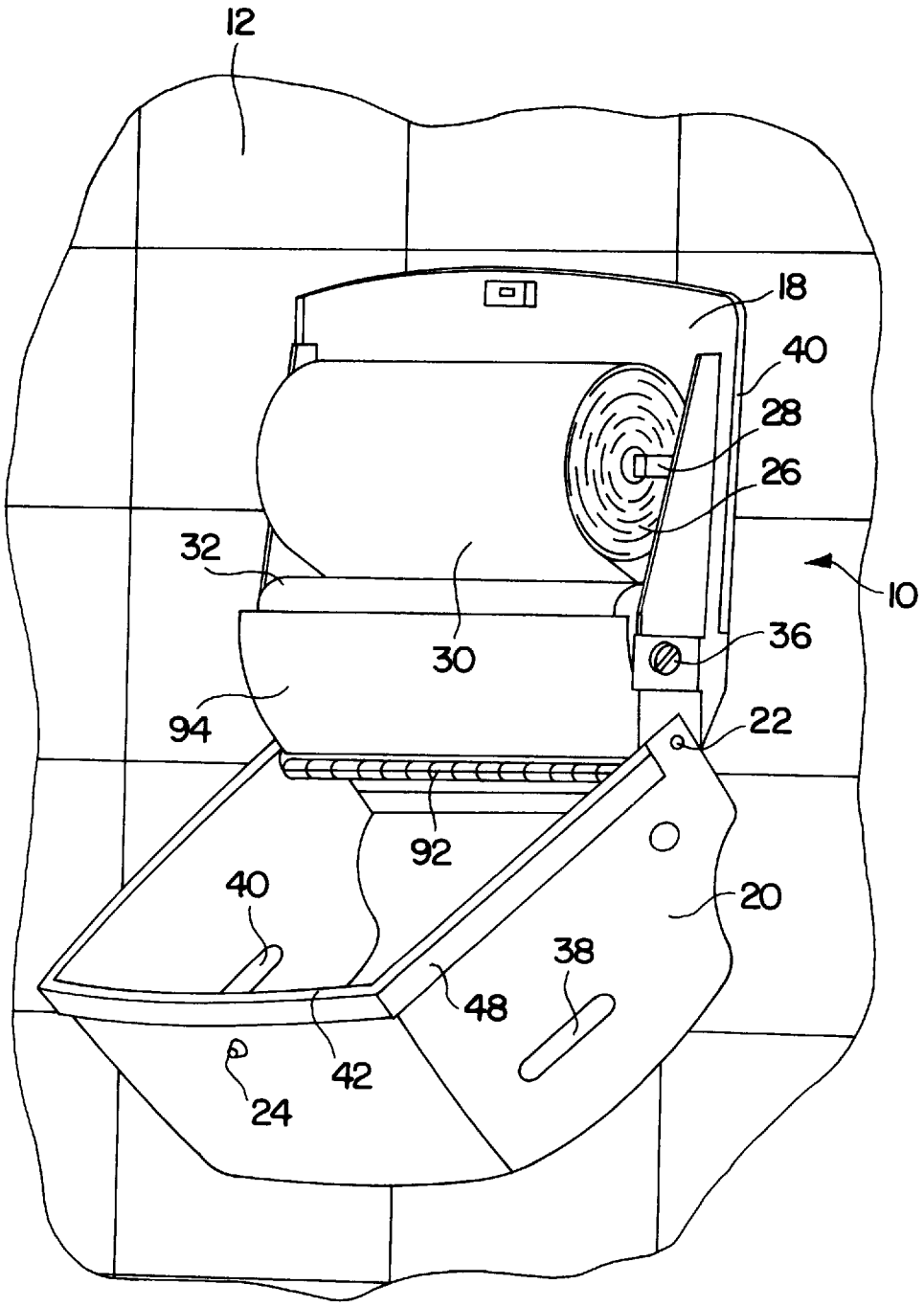
FIG. 2 is a perspective view of the roll web dispenser of FIG. 1 with its housing open to reveal various internal components therein.
Figure 3:
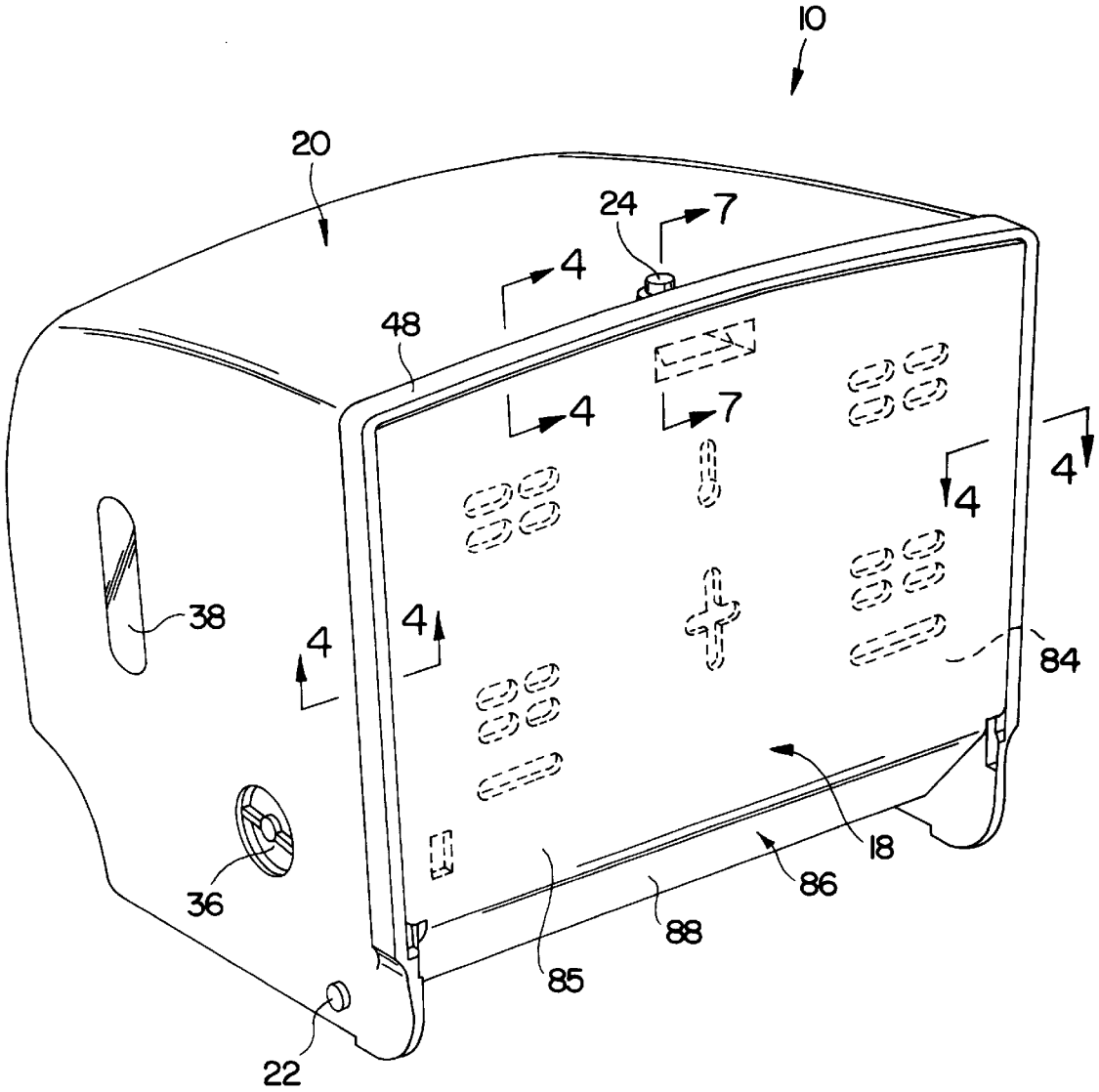
FIG. 3 is a perspective view of the roll web dispenser of FIG. 1 as seen from the rear.

Additional details of dispenser 10 can be seen in FIG. 2. The cabinet of dispenser 10 is primarily constructed in two parts, a generally planar back housing portion 18 and a molded front housing portion 20. Referring now also to FIG. 3, back housing portion 18 is configured to permit direct mounting to wall 12. Front housing portion 20 is closeable about pivot 22 onto back housing portion 18, thereby defining an interior compartment. A latch mechanism including a release button 24 is provided to releasably maintain front housing portion 20 in the closed position.

An seen in FIG. 2, the interior compartment contains a roll 26 of towel product. Roll 26 is rotatably supported in this case utilizing a pair of opposed arms, one of which is indicated at 28, pivotally connected to back housing portion 18. Each such arm will generally carry an appropriate spindle for insertion into the cylindrical core of roll 26. One of skill in the art will appreciate that various other structures may be utilized to maintain a cored or coreless roll, depending on the exigencies of a particular application.

The web 30 delivered from roll 26 passes around a drum 32 before exiting a dispenser slot 34 (FIG. 8) defined at the bottom of the dispenser housing. In the illustrated embodiment, dispenser 10 is constructed as a "no touch" dispenser in which the user retrieves lengths of product by pulling directly on the tail. For the sake of brevity, structural details of the "no-touch" mechanism will not be described in detail herein. One preferred manner of constructing such a dispenser, however, is described in copending application Ser. No. 08/206,781, now abandoned, assigned to the present assignee and incorporated herein by reference.

Preferably, the tail will extend through slot 34 a sufficient length to facilitate grasping by the user without the need to turn "emergency" feed knob 36. When the user pulls on the web tail in this manner, drum 32 is caused to rotate. As a result, a retractable blade located within drum 32 will extend to sever a predetermined length of product. The unit is designed to leave a tail through slot 34 so that the next user can repeat the process. Windows 38 and 40 may be provided in front housing portion 20 so that maintenance personnel can quickly evaluate the need to change roll 26.

Figure 4:
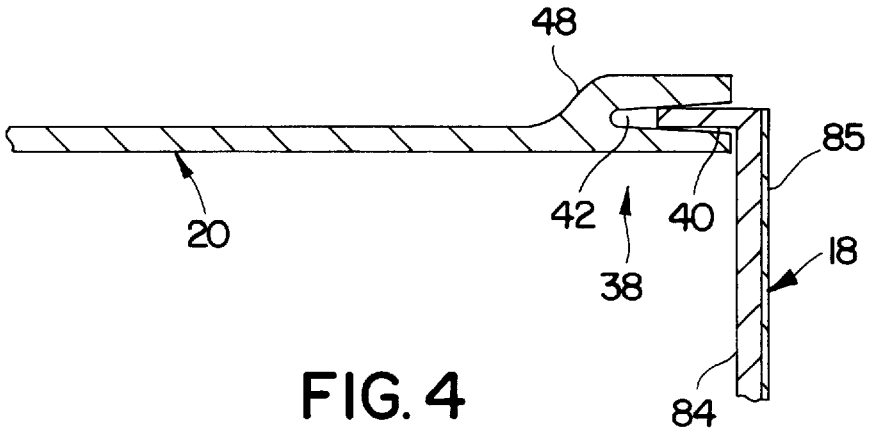
FIG. 4 is a cross-sectional view as taken along lines 4—4 of FIG. 3.

As noted above, dispenser 10 includes various features to inhibit ingress of liquid into the housing compartment. For example, water would often enter the cabinet of many prior art dispensers at the interface of the respective housing portions. As shown in FIG. 4, the present invention greatly reduces the potential for entry of liquid at this location utilizing a labyrinthine seal structure 38. Seal structure 38 comprises a perimeter lip 40 received into a perimeter groove 42. In this case, lip 40 is defined about the perimeter of back housing portion 18, whereas groove 42 is defined about the perimeter of front housing portion 20.

Figure 4A:
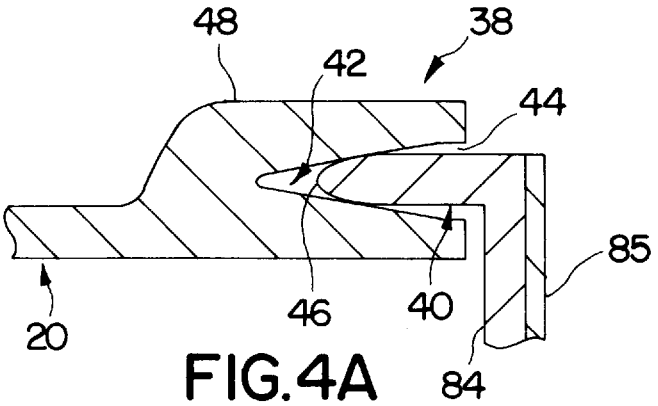
FIG. 4A is an enlarged cross-sectional view of the lip and groove combination of FIG. 4 forming a labyrinthine seal.

Additional details of seal structure 38 are apparent with reference to FIG. 4A. As can be seen, the opposed walls of groove 42 converge from a widened mouth 44. Similarly, lip 40 defines a tapered portion 46 having a reduced edge width. This configuration permits lip 40 to be easily received in groove 42 notwithstanding slight misalignments between back housing portion 18 and front housing portion 20. In addition, tangential contact between the respective tapered surfaces generally enhances the degree of sealing that may be achieved.

In this case, groove 42 is formed in a bulge 48 extending about the perimeter of front housing portion 20. This bulge advantageously functions to deflect sprayed liquid away from the dispenser housing. As a result, the liquid is even less likely to penetrate into the cabinet than would otherwise be the case.

Figure 5:
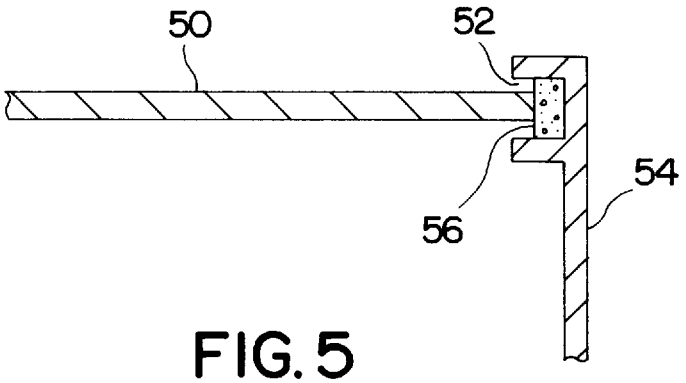
FIG. 5 PRIOR ART
FIG. 5 is a cross-sectional view similar to FIG. 4 illustrating prior art usage of a sealing gasket.

As a contrast, FIG. 5 illustrates a prior art technique that has been utilized to render a dispenser cabinet relatively resistant to liquid penetration. In this case, the edge of the front housing portion 50 is simply received into a channel 52 defined about the perimeter of the back housing portion 54. A rubberized gasket 56 is located in the channel to provide sealing between the cabinet interior and the ambient environment. While this arrangement is generally effective at providing the desired sealing, the use of a gasket can be problematic in a number of respects. The present invention advantageously eliminates the need to provide such a gasket.

Figure 6A:
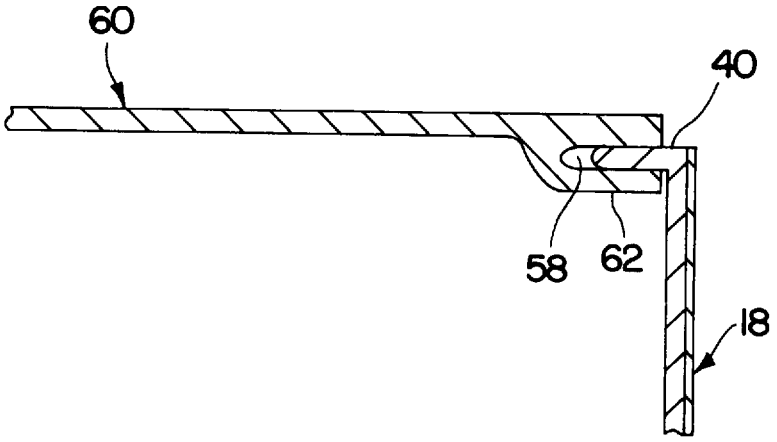
FIGS. 6A and 6B are cross-sectional views similar to FIG. 4 illustrating two alternative embodiments of the lip and groove combination.
Figure 6B:
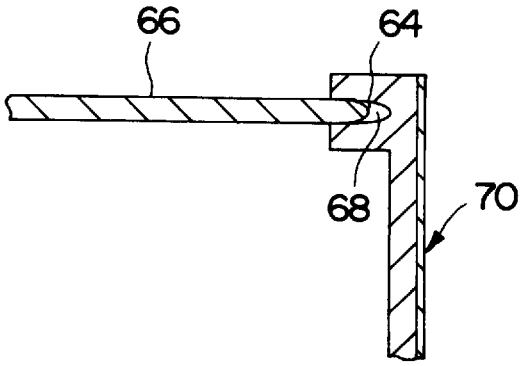

FIGS. 6A and 6B illustrate alternative constructions of the labyrinthine seal structure with which dispenser cabinets of the present invention may be equipped. In the embodiment of FIG. 6A, lip 40 is received in a groove 58 defined about the perimeter of front housing portion 60. Groove 58 is formed in a bulge 62 which, in contrast to bulge 48, extends about the interior surface of front housing portion 20.

In the embodiment of FIG. 6B, a lip 64 is formed by the edge of front housing portion 66. Lip 64 is received in a groove 68 defined about the perimeter of back housing portion 70. Preferably, lip 64 and groove 68 are tapered as in the embodiments discussed above to facilitate alignment and enhance sealing.

Figure 7:
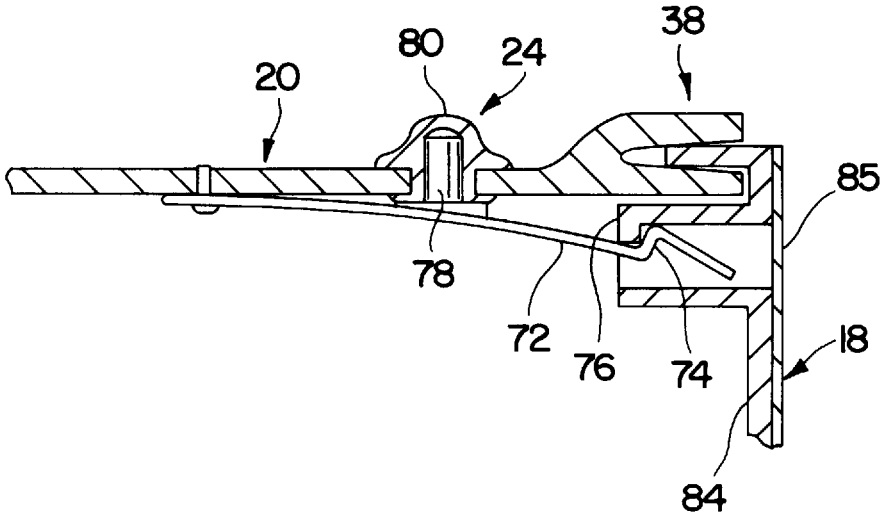
FIG. 7 is a cross-sectional view as taken along line 7—7 of FIG. 3.

FIG. 7 illustrates a preferred latch mechanism which may be utilized to releasably maintain front housing portion 20 closed on back housing portion 18. As shown, the latch mechanism includes a spring member 72 attached to front housing portion 20. Spring member 72 includes a catch portion 74 engaging a keeper 76 defined in back housing portion 18. The latch mechanism is released when a user presses release button 24.

To prevent ingress of liquid, release button 24 is configured having a button member 78 encased in a polymeric grommet 80. As shown, button member 78 is attached to spring member 72. Grommet 80, on the other hand, is attached to front housing portion 20 and thereby seals the hole through which button member 78 extends.

Figure 7A:
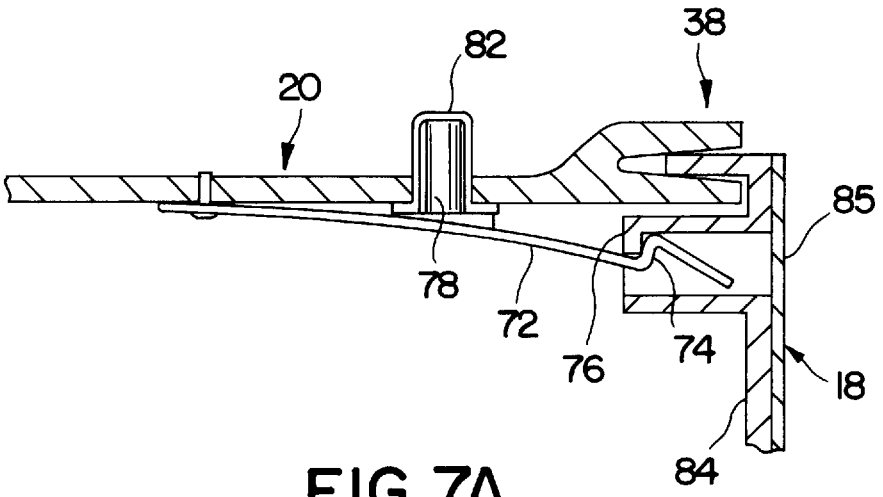
FIG. 7A is a view similar to FIG. 7 illustrating an alternative latch mechanism.

FIG. 7A illustrates a latch mechanism substantially identical to that of FIG. 7, except the grommet in this case takes the form of a polymeric boot 82 glued or otherwise attached to the inside surface of front housing portion 20. In lieu of a separate button member 78, it will also be appreciated that embodiments may be constructed in which the button member is integrally formed from spring member 72.

Figure 8:
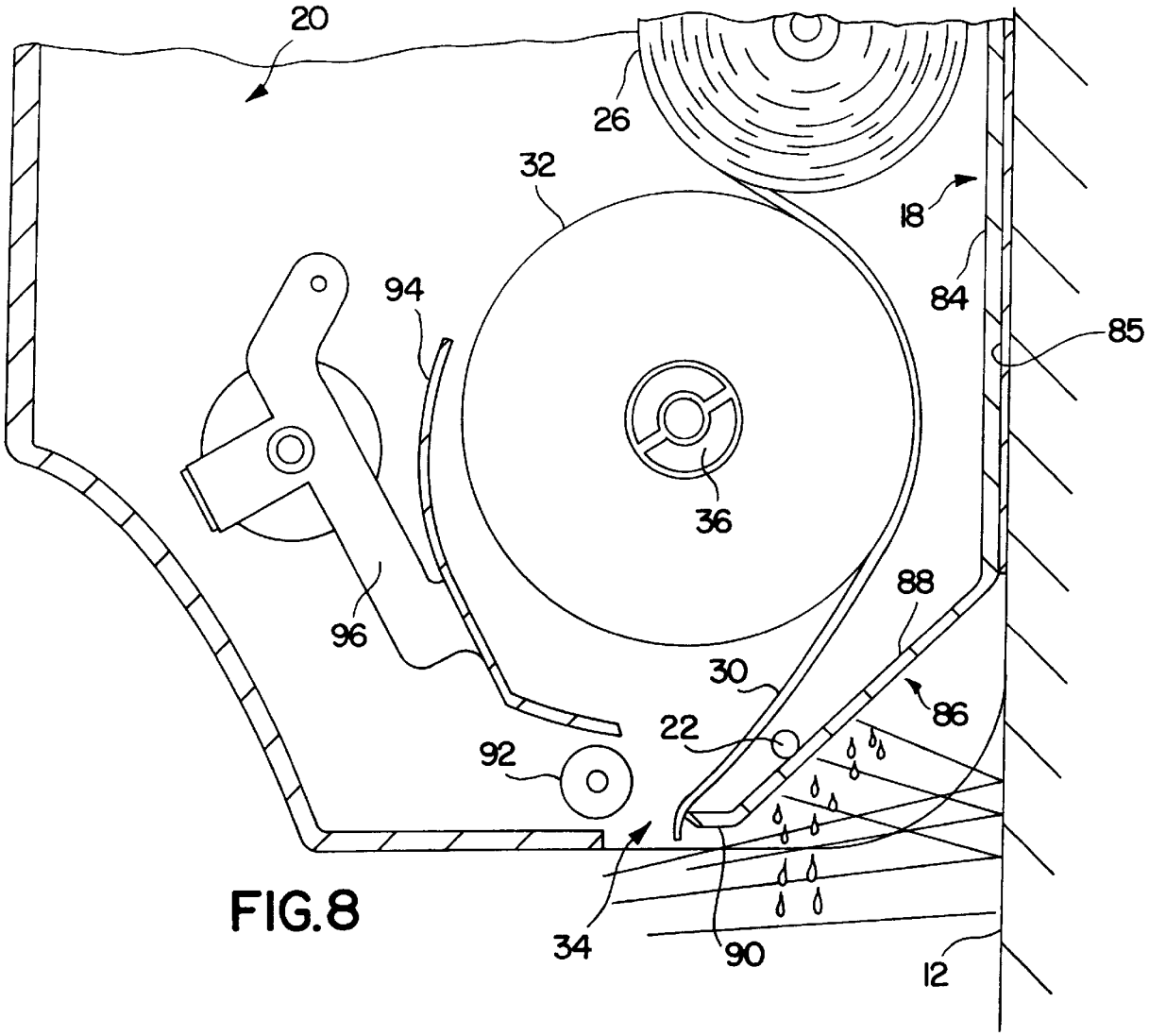
FIG. 8 is a partial cross-sectional view of the lower housing of the dispenser of FIG. 1 illustrating certain internal components thereof.

FIG. 8 illustrates in greater detail the travel path taken by web 30 from roll 26 to dispensing slot 34. It can also be seen that back housing portion 18 is configured in this case as an inner back plate 84 to which an overlay 85 has been attached. As shown most clearly in FIG. 3, overlay 85 serves to cover the various mounting holes and the like defined in back plate 84 at the time it is formed. As such, overlay 85 can be bored at only the specific holes needed in a particular application. The remaining holes stay covered, thus further enhancing resistance to liquid penetration.

Back plate 84 integrally extends into a lower deflector shield 86. Deflector shield 86 includes a first planar portion 88 sloping in from back plate 84 by a predetermined angle. A second planar portion 90 integrally extends from first planar portion 88 by a second predetermined angle. In this case, second planar portion 90 is substantially perpendicular to back plate 84.

It can be seen that the inner edge of second planar portion 90 defines one side of dispensing slot 34. The opposite side of dispensing slot 34 is defined in this case by a longitudinal roller 92.

Shield 86 functions to deflect liquid that may otherwise enter the inner compartment of dispenser 10 through slot 34. This is illustrated in FIG. 8, where a relatively high-pressure spray reflected from wall 12 is being effectively deflected. Shield 86 will deflect liquid spray from virtually any spray angle, except, of course, a vertical spray directly into slot 34.

FIG. 8 also illustrates an arcuate guard member 94 situated in front of drum 32 to inhibit access to the cutting blade by maintenance personnel. In addition, a support is provided for an auxiliary roll of towel. This support may comprise a pair of opposed arm members attached to guard member 94, such as arm member 96.

It can thus be seen that the present invention provides a water-resistant roll web dispenser satisfying the various objects set forth above. While preferred embodiments of the invention have been shown and described, modifications and variations may be made thereto by those of ordinary skill in the art without departing from the spirit and scope of the invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so set forth in such appended claims.

What is claimed is:

1. A water-resistant roll web dispenser comprising:

a back housing portion adapted to facilitate mounting of said dispenser to a mounting surface;

a front housing portion pivotally connected to said back housing portion, said front housing portion being closeable on said back housing portion to define a compartment and further defining a dispenser slot through which web product extends;

one of said front housing portion and said back housing portion defining a perimeter groove having opposed side walls and another of said front housing portion and said back housing portion defining a perimeter lip for receipt in said groove between said opposed side walls, said lip and groove mating to form a labyrinthine seal structure when said front housing portion is closed on said back housing portion; and a support structure located in said compartment to rotatably support a roll of said web product.

2. A dispenser as set forth in claim 1, wherein said groove is defined on said front housing portion and said lip is defined on said back housing portion.

3. A dispenser as set forth in claim 2, wherein said groove defines a water-deflecting bulge on a outer surface of said front housing portion.

4. A water-resistant roll towel dispenser comprising:

a back housing portion adapted to facilitate mounting of said dispenser to a mounting surface;

a front housing portion pivotally connected to said back housing portion, said front housing portion being closeable on said back housing portion to define a compartment and further defining a dispenser slot through which web product extends;

one of said front housing portion and said back housing portion defining a perimeter groove and another of said front housing portion and said back housing portion defining a perimeter lip for receipt in said groove, said lip and groove forming a labyrinthine seal structure when said front housing portion is closed on said back housing portion: and a support structure located in said compartment to rotatably support a roll of said web product;

wherein opposed inside walls of said groove are tapered to define a widened mouth.

5. A dispenser as set forth in claim 4, wherein said lip defines a tapered portion having a reduced edge width.

6. A water-resistant roll towel dispenser comprising:

back housing portion-adapted to facilitate mounting of said dispenser to a mounting surface;

a front housing portion pivotally connected to said back housing portion, said front housing portion being closeable on said back housing portion to define a compartment and further defining a dispenser slot through which web product extends;

one of said front housing portion and said back housing portion defining a perimeter groove and another of said front housing portion and said back housing portion defining a perimeter lip for receipt in said groove, said lip and groove forming a labyrinthine seal structure when said front housing portion is closed on said back housing portion:

a support structure located in said compartment to rotatably support a roll of said web product; and a latch mechanism to maintain said front housing portion closed on said back housing portion, said latch mechanism including a water-resistant release button extending through said front housing portion.

7. A dispenser as set forth in claim 6, wherein said water-resistant release button includes a button member encased in a water-resistant grommet.

8. A water-resistant roll-towel dispenser comprising:

a back housing portion adapted to facilitate mounting of said dispenser to a mounting surface:

a front housing portion pivotally connected to said back housing portion, said front housing portion being closeable on said back housing portion to define a compartment and further defining a dispenser slot through which web product extends;

one of said front housing portion and said back housing portion defining a perimeter groove and another of said front housing portion and said back housing portion defining a perimeter lip for receipt in said groove, said lip and groove forming a labyrinthine seal structure when said front housing portion is closed on said back housing portion;

a support structure located in said compartment to rotatably support a roll of said web product; and wherein said back housing portion integrally defines a generally planar back plate and a lower deflector shield, said lower deflector shield extending in an inward direction toward said dispenser slot.

9. A dispenser as set forth in claim 8, wherein said deflector shield comprises a first planar portion extending from said back plate at a first predetermined angle and a second planar portion extending from said first planar portion at a second predetermined angle.

10. A dispenser as set forth in claim 9, wherein said second planar portion is situated approximately perpendicular to said back plate.

11. A dispenser as set forth in claim 9, wherein an edge of said second planar portion defines one side of said dispenser slot.

12. A water-resistant roll web dispenser comprising:

a back housing portion adapted to facilitate mounting of said dispenser to a mounting surface;

a front housing portion pivotally connected to said back housing portion, said front housing portion being closeable on said back housing portion to define a compartment and further defining a dispenser slot through which web product extends;

said back housing portion integrally defining a generally planar back plate and a lower deflector shield, an edge of said deflector shield defining one side of said dispenser slot and being configured to inhibit ingress of water reflected from said mounting surface into said compartment; and a support structure located in said compartment to rotatably support a roll of said web product.

13. A dispenser as set forth in claim 12, wherein said deflector shield comprises a first planar portion extending from said back plate at a first predetermined angle and a second planar portion extending from said first planar portion at a second predetermined angle.

14. A dispenser as set forth in claim 13, wherein said second planar portion is situated approximately perpendicular to said back plate.

15. A dispenser as set forth in claim 12, further comprising a roller situated in opposition to said edge of said deflector shield to define a second side of said dispenser slot.

16. A dispenser as set forth in claim 12, wherein one of said front housing portion and said back housing portion defines a perimeter groove and another of said front housing portion and said back housing portion defines a perimeter lip for receipt in said groove, said lip and groove forming a labyrinthine seal structure when said front housing portion is closed on said back housing portion.

17. A dispenser as set forth in claim 16, wherein said groove is defined on said front housing portion and said lip is defined on said back housing portion.

18. A dispenser as set forth in claim 17, wherein said groove defines a water-deflecting bulge on a outer surface of said front housing portion.

19. A dispenser as set forth in claim 12, further comprising a latch mechanism to maintain said front housing portion closed on said back housing portion, said latch mechanism including a water-resistant release button extending through said front housing portion.

20. A dispenser as set forth in claim 19, wherein said water-resistant release button includes a button member encased in a water-resistant grommet.

21. A water-resistant roll web dispenser comprising:

a back housing portion adapted to facilitate mounting of said dispenser to a mounting surface;

a front housing portion pivotally connected to said back housing portion, said front housing portion being closeable on said back housing portion to define a compartment and further defining a dispenser slot through which web product extends;

a latch mechanism to maintain said front housing portion closed on said back housing portion, said latch mechanism including a water-resistant release button extending through said front housing portion; and a support structure located in said compartment to rotatably support a roll of said web product.

22. A dispenser as set forth in claim 21, wherein said water-resistant release button includes a button member encased in a water-resistant grommet.

23. A dispenser as set forth in claim 22, wherein said water-resistant grommet is attached to said front housing portion.

24. A dispenser as set forth in claim 21, wherein one of said front housing portion and said back housing portion defines a perimeter groove and another of said front housing portion and said back housing portion defines a perimeter lip for receipt in said groove, said lip and groove forming a labyrinthine seal structure when said front housing portion is closed on said back housing portion.

25. A dispenser as set forth in claim 24, wherein said groove is defined on said front housing portion and said lip is defined on said back housing portion.

26. A dispenser as set forth in claim 25, wherein said groove defines a water-deflecting bulge on a outer surface of said front housing portion.

27. A dispenser as set forth in claim 21, wherein said back housing portion integrally defines a generally planar back plate and a lower deflector shield, said lower deflector shield extending in an inward direction toward said dispenser slot.

28. A dispenser as set forth in claim 27, wherein said deflector shield comprises a first planar portion extending from said back plate at a first predetermined angle and a second planar portion extending from said first planar portion at a second predetermined angle.

29. A water-resistant paper product dispenser comprising:

a back housing portion;

a front housing portion closeable on said back housing portion to define a compartment and further defining a dispenser slot through which paper product extends;

one of said front housing portion and said back housing portion defining a perimeter groove and another of said front housing portion and said back housing portion defining a perimeter lip for receipt in said groove, said lip and groove forming a labyrinthine seal structure when said front housing portion is closed on said back housing portion;

said back housing portion integrally defining a generally planar back plate and a lower deflector shield, said lower deflector shield extending in an inward direction toward said dispenser slot;

a water-resistant latch mechanism to maintain said front housing portion closed on said back housing portion; and a support structure located in said compartment to maintain said paper product.

30. A dispenser as set forth in claim 29, wherein said groove is defined on said front housing portion and said lip is defined on said back housing portion.

31. A dispenser as set forth in claim 30, wherein said groove defines a water-deflecting bulge on a outer surface of said front housing portion.

32. A dispenser as set forth in claim 29, wherein said latch mechanism includes a water-resistant release button.

33. A dispenser as set forth in claim 32, wherein said water-resistant release button includes a button member encased in a water-resistant grommet.

34. A dispenser as set forth in claim 33, wherein said water-resistant grommet is attached to said front housing portion.

35. A dispenser as set forth in claim 29, wherein said deflector shield comprises a first planar portion extending from said back plate at a first predetermined angle and a second planar portion extending from said first planar portion at a second predetermined angle.

36. A dispenser as set forth in claim 35, wherein said second planar portion is situated approximately perpendicular to said back plate.

37. A dispenser as set forth in claim 35, wherein an edge of said second planar portion defines one side of said dispenser slot.

38. A dispenser as set forth in claim 37, further comprising a roller situated in opposition to said edge of said deflector plate to define a second side of said dispenser slot.

39. A dispenser as set forth in claim 29, further comprising a planar overlay juxtaposed to an outer surface of said back plate.

* * * * *